United States Patent [19]

Schober et al.

[11] 4,152,180

[45] May 1, 1979

[54] WATER SPRAY QUENCH PROCESS

[75] Inventors: Michael A. Schober, Stuttgart, Fed. Rep. of Germany; Albert J. Nielsen, Jr., Des Plaines; Ralph J. Piwko, Bolingbrook, both of Ill.

[73] Assignee: Borg-Warner Corporation, Chicago, Ill.

[21] Appl. No.: 870,978

[22] Filed: Jan. 20, 1978

Related U.S. Application Data

[62] Division of Ser. No. 743,554, Nov. 22, 1976, Pat. No. 4,079,919.

[51] Int. Cl.[2] ..... C21D 9/00

[52] U.S. Cl. ..... 148/153; 148/155

[58] Field of Search ..... 148/143, 153, 155

[56] References Cited

U.S. PATENT DOCUMENTS 3,546,911 12/1970 Lenz ..... 148/153

*Primary Examiner*—R. Dean

*Attorney, Agent, or Firm*—James A. Geppert

[57] ABSTRACT

A water spray quench process and apparatus for the hardening of steel agricultural discs and like articles with minimum warpage and maximum exposure to the quenching water. A steel article heated in a furnace to a temperature above its austenitizing temperature is moved horizontally into a quenching station, supported on several support pins below the article with a positioning member above the article, and sprayed with water from a series of nozzles both above and below the article to rapidly and effectively quench the article to a minimum temperature. Once the article has been cooled by the quenching water, it is expelled from the quench station.

6 Claims, 7 Drawing Figures

WATER SPRAY QUENCH PROCESS

This is a division of application Ser. No. 743,554 filed Nov. 22, 1976, now U.S. Pat. No. 4,079,919.

BACKGROUND AND SUMMARY OF THE INVENTION

The hardening of steel by heating it to a temperature at which the steel is in an austenitic state and then cooling it by a quenching operation is well known in the art. When hardening flat objects, such as flat discs, gears, wheels, etc. by ordinary methods, it is difficult to avoid warpage of the articles because of uneven immersion of the article or uneven spraying by a quenching liquid. Also, as the article must be supported during a spray quenching, substantial areas of the article are covered by the support means and thus are not exposed to the quenching spray; resulting in uneven cooling which leads to undesirable deformation of the article.

Present methods of quenching discs, such as agricultural discs, rely on quenching in oil or Austempering in a salt bath, and water spray quenching has not been applied to these discs or similar parts. The present invention, however, utilizes an effective water spray quench for the heated articles to provide a substantially uniform and rapid cooling of the article from an austenitic to a martensitic state.

The present invention comprehends a process for water spray quenching of agricultural discs and similar articles where the disc is received from a furnace at an appropriate temperature and is quenched by a controlled pressure water spray delivered simultaneously to both sides of the article, with the spray being of uniform intensity across the entire area of the article. The article remains stationary during the quenching operation and is supported during quenching upon a series of support pins which are of such dimensions as to reduce to a minimum the blockage of the spray on the article to be quenched.

The present invention provides a water spray quenching for a steel article to achieve the desired transformation from the austenitic to the martensitic stage. In conventional oil quench processes, high carbon steels are required in order to achieve the desired transformation during quenching. The more severe water spray quench of the present process enables the use of lower carbon and/or lower alloy steel resulting in a product which has a superior impact strength. Also, a steel having a lower hardenability may be used with the water spray quench to achieve the desired results.

The present invention further comprehends a quenching operation using a water spray which will provide lower initial costs and lower replacement costs for the quenchant as compared to an oil quench system. The replacement of the oil quench with a water quench will also eliminate the fire hazards associated with oil and any pollution control problems due to an oil quench.

The unique process described above may be summarized as a process for hardening steel articles by water quenching comprising the steps of heating the article to a temperature above its austenitizing temperature, rapidly moving the article to a quenching zone and retaining the article in a stationary position, simultaneously spraying both sides of the article with water to effectively and completely transform the article to martensite, and expelling the quenched article from the quenching zone.

A further consideration for the present invention is the provision of a novel water spray quenching apparatus for handling and cooling the hot article from the austenitizing furnace. A conveyor leads from the furnace into the quenching station where the heated article is suitably positioned relative to the spray quenching nozzles. The conveyor within the quenching station then drops away to leave the article supported on a series of support pins and water is simultaneously sprayed onto both the upper and lower surfaces of the horizontally oriented article. Once the spray is terminated, the conveyor is moved upward to engage the cooled article and expell it from the quenching station.

Further objects are to provide a method and apparatus of maximum simplicity, efficiency, economy and ease of assembly and operation, and such further objects, advantages and capabilities as will later more fully appear and are inherently possessed thereby.

DESCRIPTION OF THE PREFERRED EMBODIMENT

Figures 1, 6:
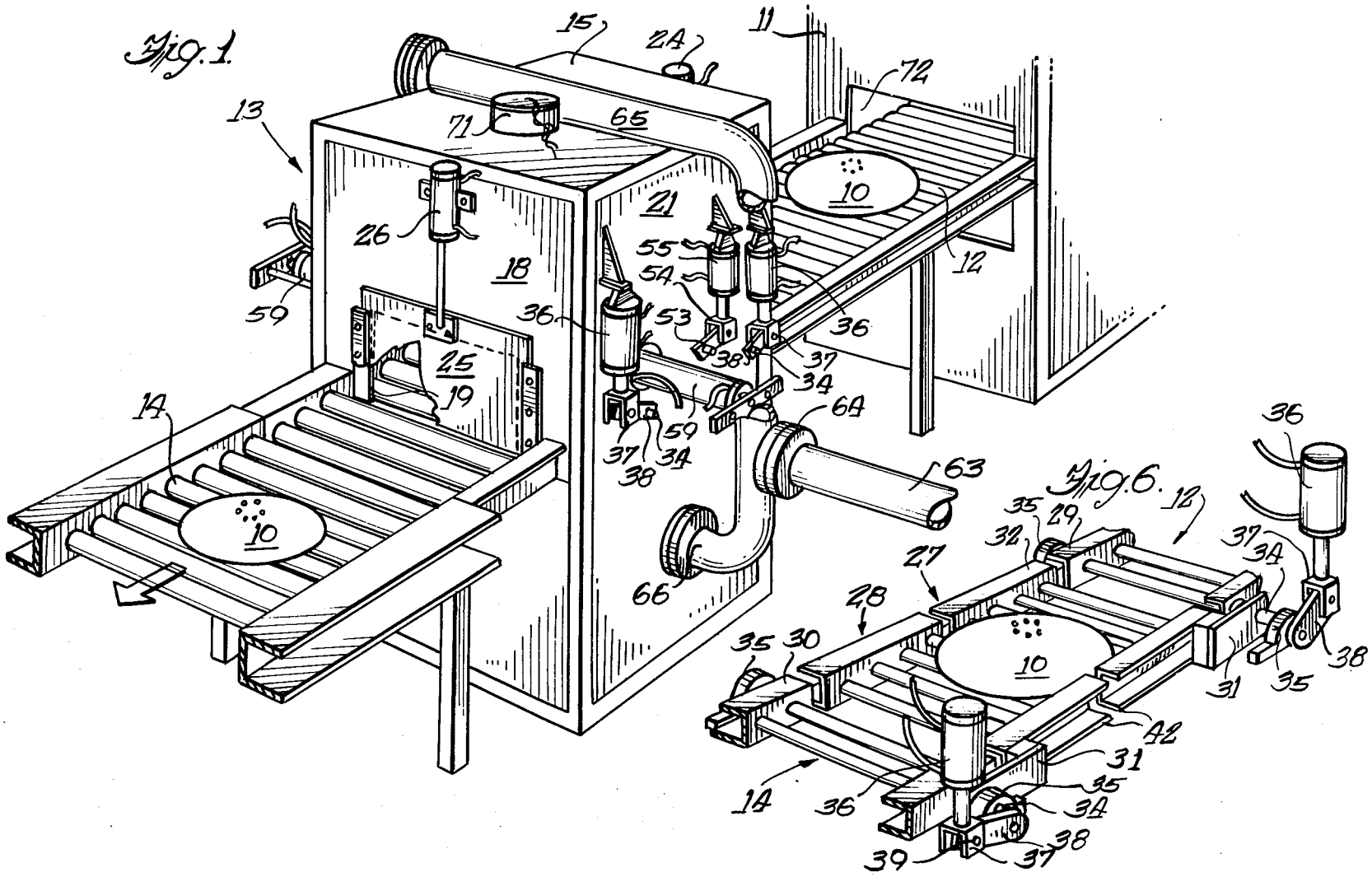
FIG. 1 is a perspective view of the quenching station, conveyor and furnace to practice the process of the present invention.
FIG. 6 is a perspective view of the conveyor within the quenching station and showing the means to retract the conveyor.

Referring more particularly to the disclosure in the drawings wherein is shown an illustrative embodiment of the present invention, FIG. 1 discloses one or more agricultural discs 10, which may be utilized in a disc harrow or similar agricultural implement, moving on a conveyor 12 from a furnace 11 to a quenching station 13 and, once quenched, moving on a second conveyor 14 to any subsequent operations necessary to provide the finished product. The furnace 11 has a separate conveyor system extending therethrough to be later described so that a disc 10 entering the furnace 11 at the right-hand end (not shown in FIG. 1) moves through the furnace to heat the disc above its austenitizing temperature.

The quenching station 13 includes a housing having a top wall 15, a front wall 16 having an entrance opening 17 to receive a disc from the conveyor 12, a rear wall 18 having an exit opening 19 to allow for removal of the quenched disc and a pair of side walls 21, 22. A sliding door 23 actuated by a piston and air cylinder 24 reciprocates to close the entrance opening 17, and a second sliding door 25 actuated by another piston and air cylinder 26 controls access for the opening 19. A pair of movable conveyor sections 27, 28 extend between the front and rear walls 16 and 18, respectively, to be in alignment with the end 29 of conveyor 12 and the beginning 30 of the conveyor 14. The conveyor sections each includes a pair of parallel channel members 32 with a plurality of spaced parallel rollers 33 extending therebetween. The pairs of channel members are pivotally mounted on the ends 29 and 30 of the conveyors 12 and 14, respectively, by pins 34 in bearings 35 at the side walls 21, 22 (FIG. 6). Both channel members 32 of each conveyor section 27 or 28 are affixed to mounting arms 31 at one end with the opposite end of the arms secured to rotate with pins 34. On side wall 21, a piston and air cylinder 36 is mounted adjacent each edge with the piston projecting downwardly and terminating in a clevis 37. An arm 38 secured at one end to a pivot pin 34 extends generally outwardly and upwardly, as seen in FIG. 1, to a point between the arms of the clevis 37 so that aligned openings in the arm 38 and clevis arms receive a pivot pin 39. These cylinders control the pivotal movement of the conveyor members 27, 28.

A pair of curved support members 41, 41 are secured in the housing on channel members 45, 45 and spaced from the side walls to extend between the first and second rollers 33', 33' at the inner free ends 42, 42 of the rails 32. A cross member 40 extends across and connects the lower ends of members 41, 41 and provides a mounting bar for a pair of curved support pins 43, 43 for each conveyor section. The pins are aligned to extend between the rollers 33', 33' when the sections are horizontal; the support pins having substantially the same curvature as the support members 41, 41 to allow pivotal movement of sections 27, 28. The upper end 44 of each support pin 43 is positioned just below the support plane of the rollers 33, 33' when the sections 27, 28 are aligned horizontally.

A pair of parallel channel members 45, 45 are mounted on the interior surfaces of the side walls 21, 22 and are spaced above the conveyor sections 27, 28 to extend between the front and rear walls 16 and 18, respectively. Each member 45 supports a bearing block 46 receiving an end of a transversely extending shaft 47 carrying an arm 48 terminating at its free end in a depending positioning pin 49 having radially extending fingers 51. One end 52 of the shaft 47 extends through the side wall 21 to terminate in a lateral arm 53 having its free end pivotally mounted in a clevis 54 controlled by a piston and cylinder 55 mounted on the wall 21.

Figure 2:
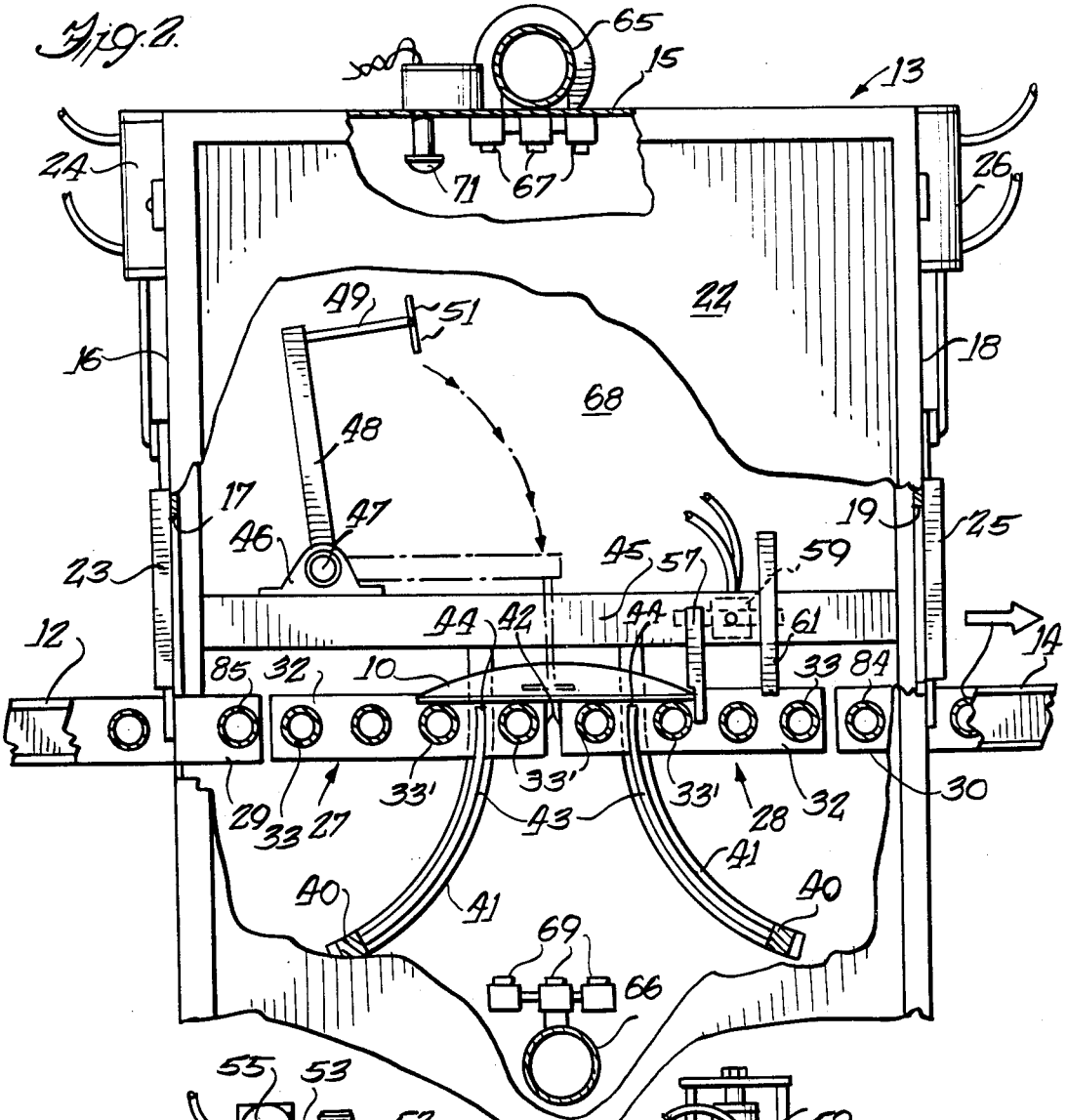
FIG. 2 is a side elevational view, partially broken away, of the quenching station and showing the conveyor supporting the article to be quenched.
Figure 5:
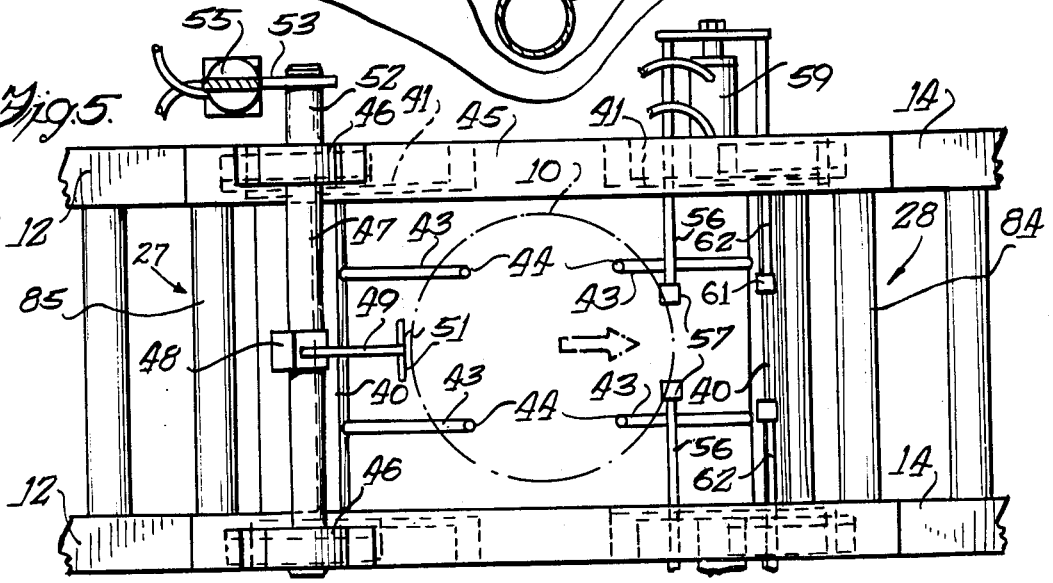
FIG. 5 is a top plan view of the conveyor and supporting means within the quenching station with the conveyor sections retracted.

Extending inwardly through the side walls 21, 22 and channel members 45 are a pair of reciprocable rods 56, 56 terminating at their inner ends in a pair of depending positioning members 57, 57, preferably having cut-away lower portions 58, 58. At the exterior of the side walls 21, 22 are located laterally extending piston and air cylinders 59, 59 acting to control reciprocation of the rods 56, 56 and members 57, 57. Mounted forwardly of the members 57, 57 (to the right as seen in FIG. 2) are a second pair of vertical positioning members 61, 61 mounted on the inner ends of a second set of reciprocating rods 62, 62, also controlled by the pistons and cylinders 59, 59 and utilized for a larger disc than that presently shown.

Water for the quenching operation is supplied from a pressure vessel (not shown) through a main pipe 63 having a control valve 64 therein to an upper branch pipe 65 and a lower branch pipe 66. The branch pipe 65 is positioned on the top wall 15 with a plurality of spray nozzles 67 depending therefrom through the wall 15 into the quenching chamber 68. The branch pipe 66 extends through the side wall 21 below the support members 41, support pins 43 and conveyor members 27, 28. A plurality of spray nozzles 69 extend upwardly from the pipe 66. The spray nozzles 67 and 69 are so arranged as to provide a spray pattern completely covering the surface area of the article 10 to be quenched, and check valves (not shown) are provided at the nozzles so that the headers are always filled with water. An infrared detector 71 is positioned in the top wall 15 to sense the presence of a hot article and provide a signal to initiate the quenching operation.

Figure 7:
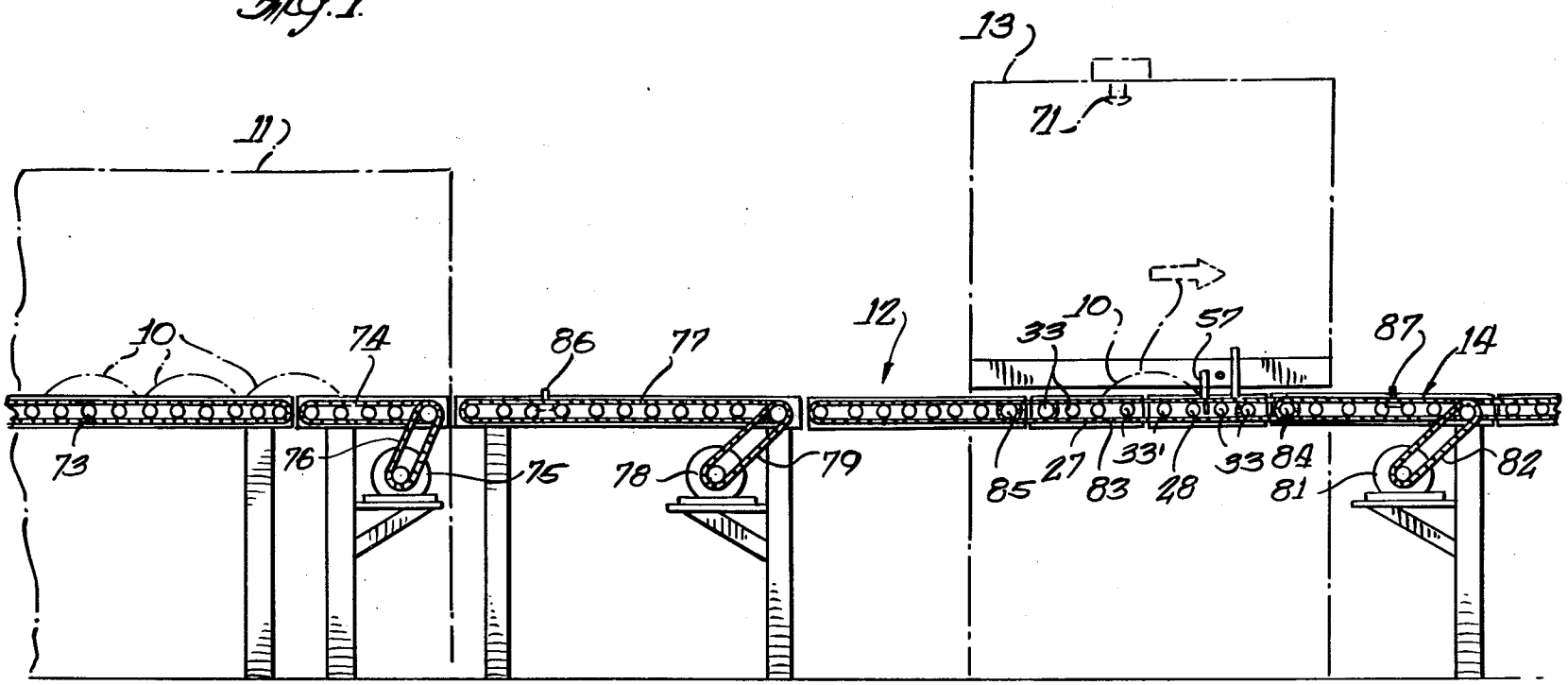
FIG. 7 is a side elevational view of the conveyor system utilized for the furnace and quenching apparatus.

With reference to FIG. 7, a conveyor 73 carries the discs 10 continuously through the furnace at an appropriate rate so that the discs are heated to a temperature above the austenitizing temperature for the particular steel composition. Adjacent the exit 72 of the furnace is located a short conveyor 74 driven by a two-speed motor 75 and drive chain 76. This motor has a low conveyor speed equal to that of the conveyor 73 and a second speed that is much higher. As an example, the conveyor 73 may have a speed of six feet per minute, and the conveyor 74 has the same low speed and a high speed of 130 feet per minute. Interposed between the conveyor 74 and the conveyor 12 leading into the quench station 13 is a conveyor section 77 driven by a motor 78 and chain 79, although this conveyor section 77 may be an extension of the conveyor 12 and is driven at a single speed equal to the high speed of the conveyor 74.

The conveyor 14 is driven by a single speed motor 81 and drive chain 82 at a speed equal to the high speed of the conveyor 74; the motor driving the rollers of the conveyor 14 and the rollers 33, 33' of conveyor section 28 in the quench station 13 through a progressive chain arrangement. A jump chain 83 connects the first rollers 84 of conveyor 14 with the last roller 85 of conveyor 12, and the roller 85 drives the rollers 33, 33' of conveyor section 27 in the quench station 13 as well as the rollers of conveyor 12 through a progressive chain arrangement. A first microswitch 86 is positioned in the conveyor section 77 and a second microswitch 87 is positioned in the conveyor 14, both microswitches acting to control the dual speed motor 75.

Prior to quenching, a pressure vessel (not shown) is charged with water at a prescribed temperature and pressurized to a particular level; the butterfly valve 64 being closed. The water may be heated by passing it through an automatically controlled steam heat exchanger or cooled by passage through a cooling tower as required by the particular article to be quenched as the water is pumped into the pressure vessel; the vessel acting as an accumulator with compressed air above the water in the closed space. The articles 10 to be quenched are sequentially fed into the furnace on the conveyor 73 to be heated to a temperature above its austenitizing temperature prior to exiting through the furnace exit 72. The articles on the conveyor 73 are generally closely spaced together.

Assuming that a disc 10 has been quenched in the station 13, the quenching cycle provides that the air cylinders 24 and 26 are actuated to raise the doors 23 and 25, and the conveyors 77, 12, 27, 28 and 14 are activated to expell the quenched disc on conveyor 14 to any desired subsequent operations. As the disc moves onto conveyor 14, it trips the microswitch 87 to actuate the pistons and cylinders 59 and move the positioning members 57 laterally over the conveyor sections 27, 28 to stop the next disc, and to switch the conveyor section 74 to its high speed. Thus, as the heated disc 10 moves onto the conveyor 74, it is quickly transferred at the higher speed along conveyors 74, 77 and 12 through the opening 17 and onto the conveyor sections 27, 28 to be stopped by the positioning members 57; the cutaway portions 58 on the members 57 acting to center the disc over the ends 44 of the support pins 43. As the disc moves over the conveyor 77, it trips the microswitch 86 to return the conveyor 74 to the lower speed.

Figure 3:
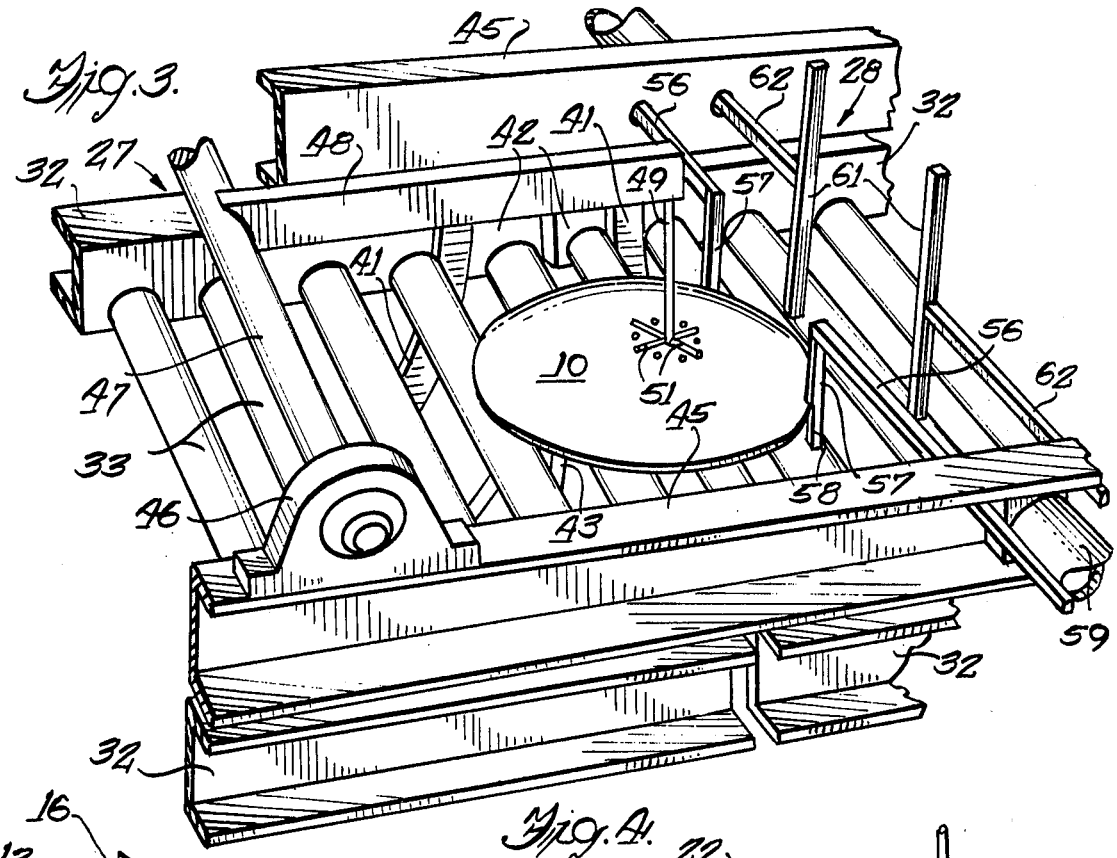
FIG. 3 is a perspective view of the conveyor within the quenching station and showing the means for positioning the article for quenching.
Figure 4:
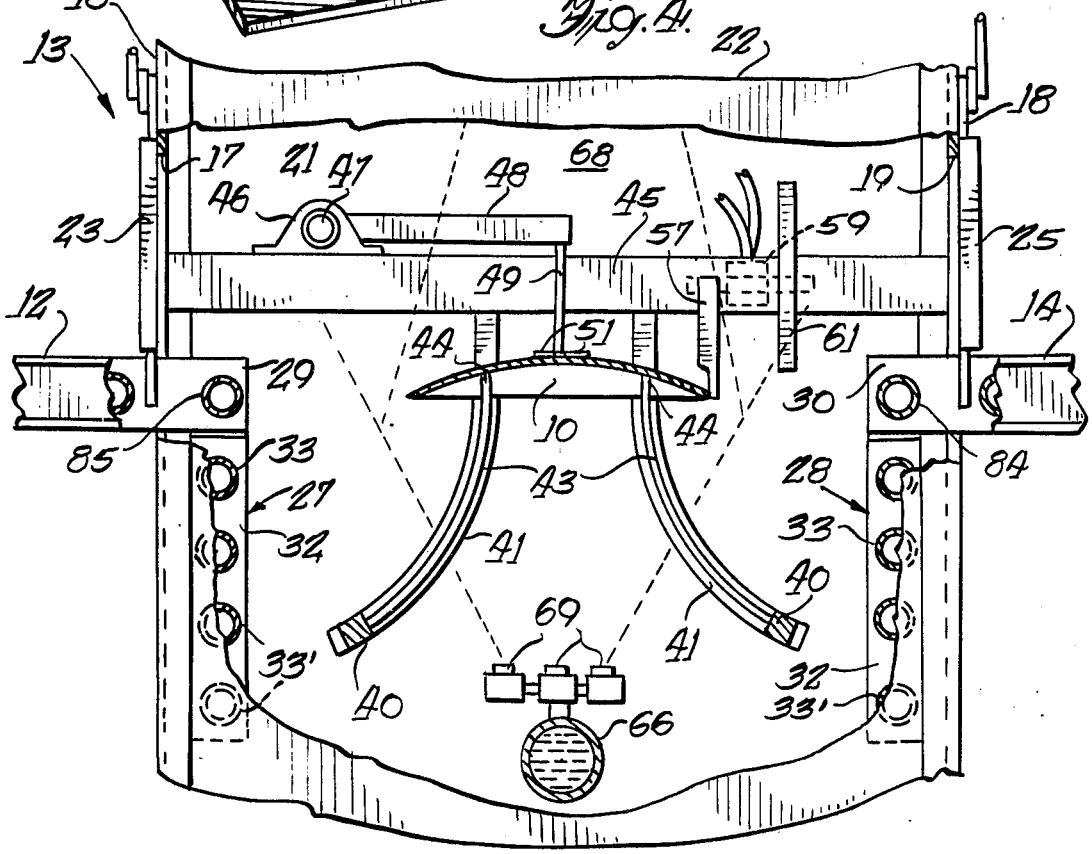
FIG. 4 is a side elevational view, partially broken away, similar to FIG. 2 but showing the conveyor in its retracted position preparatory to quenching.

The infrared detector 71 senses the presence of the disc 10 and confirms that the disc has been heated to the proper temperature. A signal from the detector deactivates the drive motors 78 and 81 to stop conveyors 77, 12, 27, 28 and 14, actuates the pistons and cylinders 24 and 26 to lower the doors 23 and 25 and actuates the piston and cylinder 55 to rotate the arm 53 and the shaft 47 to move the arm 48 in a clockwise direction (see FIGS. 2 and 3) so that the radial fingers 51 and pin 49 rest on the center of the disc. Simultaneously, the pistons and cylinders 36, 36 are actuated to rotate the arms 38, 38 and retract the conveyor sections 27, 28 about the pivot pins 34, 34. Retraction of the conveyor sections lowers the disc onto the support pins 43. Then the pistons and cylinders 59, 59 are actuated to retract the rods 56 and positioning members 57 away from the disc.

The butterfly valve 64 opens causing pressure in the upper and lower headers 65 and 66 to rise above the check valve pressure and flow begins through the nozzles 67 and 69 onto the upper and lower surfaces of the disc. Check valves (not shown) are utilized with the nozzles 67, 69 to guarantee that the upper and lower water sprays impinge on the disc simultaneously. When the predetermined spray time has elapsed, the valve 64 closes, stopping the spray, followed by actuation of the pistons and cylinders 36, 36 to rotate the conveyor sections 27, 28 to their horizontal position and lift the quenched disc off of the support pins 43. Simultaneously, the piston and cylinder 55 is actuated to lift the pin 49 and fingers 51, and the pistons and cylinders 24 and 26 are actuated to lift the doors 23 and 25. When the conveyor sections 27, 28 reach their horizontal position, the conveyors 14, 27, 28, 12 and 77 are actuated to expell the disc from the quench chamber 68 onto the conveyor 14.

The disc trips the microswitch in conveyor 14 to initiate the next quenching cycle for another disc 10 from the furnace. All of the piston and cylinder assemblies are preferably air-actuated for quickness of action and response, and a suitable control system for the sequential actuation of the pistons and cylinders and the control valve can be easily devised. The quenching chamber opens directly into a sump or catch tank so that the water utilized in the quenching operation may be collected and recycled or discarded.

Unlike the known methods of continuous quenching of a continuous plate or rod, the present method is designed for individual parts which are held stationary during the quench, and the parts are not held in a substantially confined or enclosed quenching fixture. In the present method, the spray is uniform over the entire surface area of the quenched article, with the uniformity being controlled through the selection and physical spacing of the spray nozzles and regulation of the spray pressure. If a part is to be physically held during quenching, a primary concern is the extent of shadowing or spray blockage caused by the holding device. Obviously the rollers of a conveyor would provide substantial shadowing of the part; however, the twin hinged conveyor sections, by swinging away from the article and allowing support by the pins, eliminates the potential shadowing by the conveyor interferring with spray from the lower header. The support pins offer minimal shadowing during quenching.

The water spray quench process utilizes a water spray having controlled pressure, temperature, droplet size and total flow rate which is delivered simultaneously to both sides or surfaces of the article to be quenched. The spray must be uniform in intensity across the entire area of the disc, and the water droplets must possess sufficient kinetic energy to penetrate the vapor layers which build up during the quench, but must not be overly large. As the droplet size is increased above a certain point, the warpage of the quenched part increases, apparently due to the coarseness and localized nonuniformity of the spray. Examples of quench parameters are shown in the following table to produce agricultural discs:

Table I

| Disc. Size Dia. & Thickness | Quench °F. | Water Pressure | Nozzle Orifice Dia.) | Total Flow (g.p.m.) | Rate Per Surface Area (g.p.m./ft$^2$) |
|---|---|---|---|---|---|
| 24" × 0.250" | 80–90 | 70 psi | 0.50" | 2330 | 180 |
| 20" × 0.148" | 72–82 | 50 psi | 0.50" | 1960 | 150 |
| 14" × 0.083" | 75–80 | 25 psi | 0.50" | 750 | 93 |
| 13.5" × 0.083" | 75–80 | 30 psi | 0.50" | 840 | 103 |

All of these examples are of approximately the same carbon content of 0.40%C. For a carbon content of 0.04% or lower, the quench water when recycled may require cooling to a level of approximately 60° F. A higher quench water temperature to eliminate quench cracking (120°–160° F.) may be required where a thinner steel article of 0.42%C. and higher is utilized in the quenching operation. For a higher quench water temperature, the steam heat exchanger may be necessary.

Although this process has been disclosed for treatment of flat or curved, comparatively thin, plates of steel, such as agricultural discs, this process and apparatus is contemplated to be useful for treatment of other agricultural implements or Belleville springs. The water quench provides a rapid cooling of the article so that the article at its austenitizing temperature is completely transformed to martensite. Also, this rapid quench enables the use of articles formed of lower carbon and/or lower alloy steels compared to those used presently.

We claim:

1. A process for hardening steel articles by water quenching comprising the steps of heating the article to a temperature above its austenitizing temperature, rapidly moving the article to a quenching zone onto a primary support and retaining the article in a stationary position, providing a minimum area support below the primary support, removing the primary support to lower the article onto the minimum area support, simultaneously spraying both sides of the article with water to effectively and completely transform the article to martensite, returning the primary support for the quenched article, and expelling the quenched article from the quenching zone.

2. The process as set forth in claim 1, in which said article is horizontally positioned in said quenching zone and supported at a minimum area to prevent shadowing during the quenching step.

3. The process as set forth in claim 1, in which said primary support comprises a pair of conveyor sections and said minimum area support comprises a plurality of support pins, the conveyor sections being swung downward and away from the article to lower the article onto said support pins prior to spraying.

4. The process as set forth in claim 3, in which the conveyor sections are swung upward to return to horizontal alignment after the spraying operation to lift the quenched article off of said support pins and expell the article from the quenching zone.

5. The process as set forth in claim 1, in which pressurized quench water supplied to upper and lower headers in the quenching zone is simultaneously projected through a plurality of spray nozzles onto the article.

6. A process as set forth in claim 5, including the step of sensing the presence of a heated article in the quenching zone and initiating said quenching spray as a result of the sensed article.

* * * * *